United States Patent [19]

Johns

[11] Patent Number: 4,809,973

[45] Date of Patent: Mar. 7, 1989

[54] WEIGHT TRAINING MACHINE SAFETY SHIELD

[75] Inventor: George A. Johns, Richardson, Tex.

[73] Assignee: Nautilus Sports Medical Industries, Inc., Dallas, Tex.

[21] Appl. No.: 181,928

[22] Filed: Apr. 15, 1988

[51] Int. Cl.[4] ..... A63B 21/06

[52] U.S. Cl. ..... 272/118; 272/117; 272/134

[58] Field of Search ..... 272/117, 118, 134; 266/903

[56] References Cited

U.S. PATENT DOCUMENTS

| | | | |
|---|---|---|---|
| 223,668 | 1/1880 | Duplessis | 272/118 |
| 2,949,110 | 8/1960 | Lee | 272/118 X |
| 3,820,782 | 6/1974 | Salkeld | 272/134 X |
| 4,317,566 | 3/1982 | Uyeda et al. | 272/118 |
| 4,361,323 | 11/1982 | Segersten | 272/118 |
| 4,431,181 | 2/1984 | Baswell | 272/134 X |
| 4,546,971 | 10/1985 | Raasoch | 272/134 X |
| 4,606,540 | 8/1986 | Chin-Sen | 272/117 X |
| 4,624,457 | 11/1986 | Silberman et al. | 272/134 X |
| 4,697,809 | 10/1987 | Rockwell | 272/118 |

FOREIGN PATENT DOCUMENTS

| | | | |
|---|---|---|---|
| 58-112351 | 1/1983 | Japan | 272/134 |

*Primary Examiner*—Vincent Millin
*Assistant Examiner*—Franklin L. Gubernick
*Attorney, Agent, or Firm*—Hubbard, Thurman, Turner & Tucker

[57] ABSTRACT

Disclosed is a safety shield for a weight training machine. The safety shield includes a first shield member mountable about the weight stack of the weight training machine and a second shield member telescopingly engageable with the first shield member. The shield members are preferably made of a clear or tinted plastic material and they are sized such that the weight stack is enclosed at all times during normal operation of the weight machine.

19 Claims, 2 Drawing Sheets

WEIGHT TRAINING MACHINE SAFETY SHIELD

BACKGROUND OF THE INVENTION

A. Field of the Invention

The present invention relates generally to weight training devices, and more particularly to a safety shield for enclosing the weight stack of a weight training machine.

B. Description of the Prior Art

Weight training machines have become popular with athletes and general fitness enthusiasts. Weight training machines offer advantages over free weights by allowing the user to isolate specific muscle groups and work against optimum resistance over the entire range of motion of the muscle. The muscle group isolation provided by the machine enhances the training and reduces the risk of injury. Weight training machines are also advantageous over free weights in that they reduce the clutter in the weight room.

Weight training machines typically include a body support or restraint that supports the body of the user and properly positions and isolates the muscle group being worked. The machine also includes a movable element to which the user applies the force to provide the exercise. The movable element is connected through a mechanical linkage to a stack of weights that provides the resistance.

The stack of weights includes a plurality of weight plates that are vertically movable in a frame. The user can mechanically link together a selected number of the weight plates thereby to select the amount of resistance applied during the exercise. As the user exercises, the selected weight plates are moved up and down in the frame.

The moving weights in the weight machine are a potential source of injury. For example, a bystander might carelessly get his or her feet or hands or other body parts caught between the weights. Also, the user, during selection of the weights, could possibly get his or her hand pinched. The injury potential possibly increases the cost to the gym or health club owner due to increased insurance costs and the necessity to hire additional supervisory personnel. Also, the potential for injury may make some people less likely to use or be around weight training machines.

It is therefore an object of the present invention to provide a safety device for a weight training machine that overcomes the shortcomings of the prior art. More particularly, it is an object of the present invention to provide a safety shield that encapsulates the weight stack at all times during normal operations thereby to prevent bodily contact with the moving weights.

It is a further object of the present invention to provide a safety shield in which the weight stack is encapsulate at all times but with which the weight stack guide rods, chains, and other fixtures, are accessible at all times for routine maintenance, cleaning, lubrication, and adjustment. It is a further object of the present invention to provide a safety shield in which the weight stack is encapsulated at all times, but in which the weight stack is visible at all times.

It is yet a further object of the present invention to provide a safety shield that can be installed or retrofitted on existing machines without having to modify the machine or drill holes, weld, cut, or glue. It is a further object of the present invention to provide a safety shield that is relatively inexpensive and one that is adaptable to various machines, thereby reducing inventory costs.

SUMMARY OF THE INVENTION

Briefly stated, the foregoing and other objects are accomplished by the safety shield of the present invention. The safety shield includes first and second shield members that are mountable about the stack of weight plates. The first shield member has opposed front and back walls, opposed side walls, and a bottom wall, which is positionable beneath the weight stack such that the walls enclose the stack of weight plates. The front wall includes an elongated slot that is positioned to allow limited access to the plates of the weight stack so that a selected number of plates may be linked to a stack pin to be lifted by the exerciser. The second shield member is telescopingly engageable with the first shield and includes opposed front and back walls, opposed side walls, and a top wall. The top wall is positionable over the top of the weight stack and it is fixed to move with the top weight of the weight stack during operation of the weight machine. The front wall of the second shield member also includes an elongated slot that registers with the slot of the first shield member, again to allow limited access to the weight stack so that the selection pin may be used to select the desired number of weight plates to be lifted.

In accordance with an important aspect of the invention, all or a portion of the shield members are fabricated entirely or at least partially of clear or tinted plastic which enables the user to see how many weight plates are being lifted.

The combined lengths of the first and second shield members are at least equal to the height of the weight plates stack plus the maximum travel of the weights during operation. Thus, all of the weight plates of the stack are enclosed at all times during operation of the weight machine except for the limited access allowed by the slots.

DESCRIPTION OF THE PREFERRED EMBODIMENT

Figure 1:
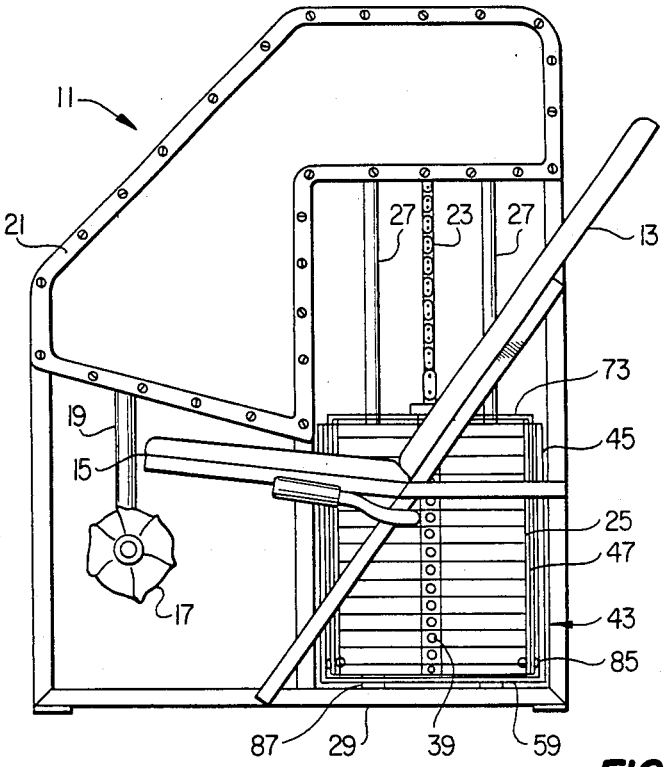
FIG. 1 is a side elevation view of a weight training machine including the safety shield of the present invention.

Referring now to the drawings, and first to FIG. 1, a representative weight training machine is designated generally by the numeral 11. Weight training machine 11 is a leg extention machine that is adapted to exercise the quadriceps muscles. The user sits in a chair 13, which is part of machine 11, with his or her legs hanging over the edge 15 of chair 13 and with his or her shins or ankles engaging a pad 17. Pad 17 is connected to an arm 19 mounted within a housing 21 of machine 11.

Housing 21 contains various chains, sprockets and cams that transmit movement of arm 19 to a chain 23. The details of the machinery within housing 21 are not pertinent to the present invention and they are believed to be well known to those skilled in the art.

Figure 2:
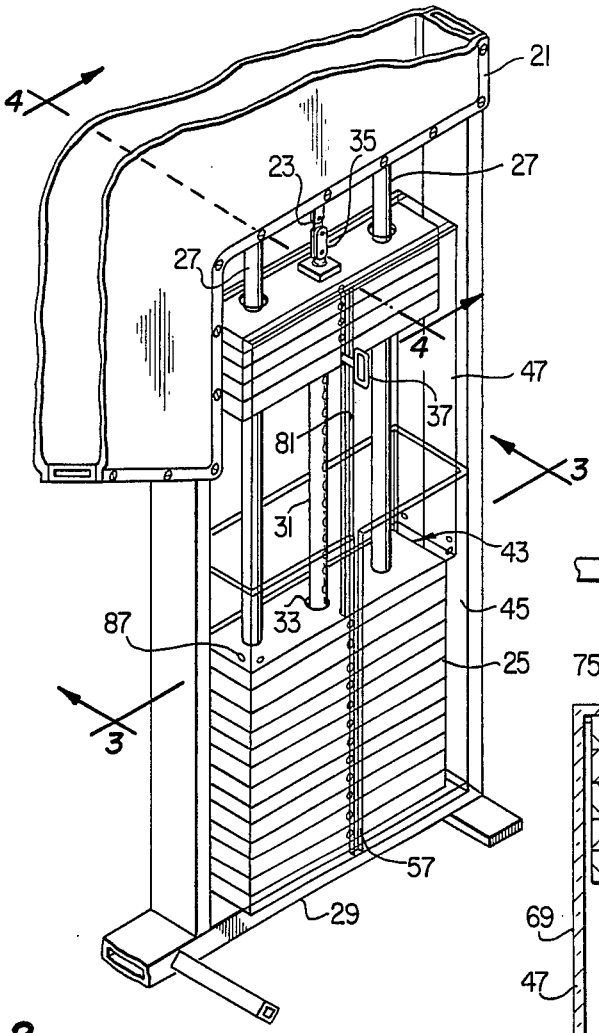
FIG. 2 is a perspective view of a portion of the weight training machine of FIG. 1 showing details of the safety shield of the present invention.
Figure 4:
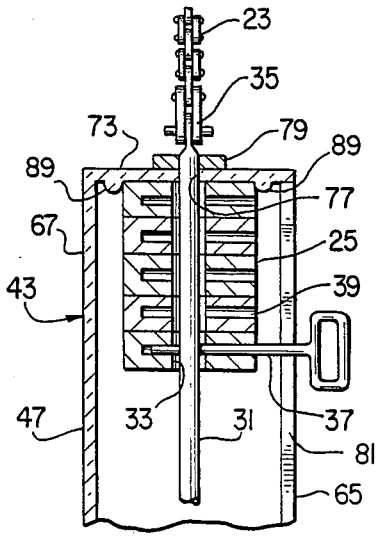
FIG. 4 is a sectional view taken along line 4—4 of FIG. 2 showing further details of the safety shield of the present invention.
Figure 3:
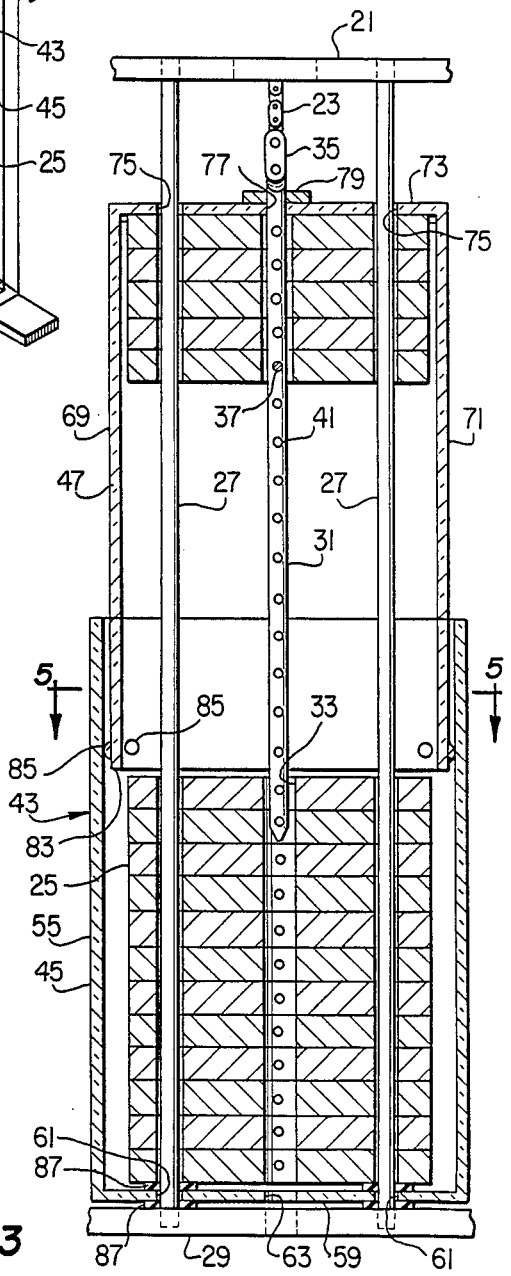
FIG. 3 is a sectional view taken along line 3—3 of FIG. 2 showing details of the safety shield of the present invention.

Chain 23 is connectable to a weight stack 25, which includes a plurality of weight plates. The plates of weight stack 25 are vertically movably mounted on spaced apart guide rods 27 that are mounted between a base 29, which supports machine 11, and housing 21. As best shown in Figs. 2–4, chain 23 is connectable to the plates of weight stack 25 by means of a stack pin 31 that passes through holes 33 in the center of each plate of weight stack 25. Stack pin 31 is connected to chain 23 by a master link 35. Selected plates of weight stack 25 are connectable to stack pin 31 by means of a retainer pin 37. Each weight plate includes a side hole 39 and stack pin 31 has a plurality of spaced apart holes 41 along its length. When weight stack is in its initial condition, as shown in FIG. 1, each hole 39 of the plates of weight stack 25 registers with a hole 41 of stack pin 31. The user selects a resistance by inserting retainer pin 37 into an appropriate hole 39, thereby linking the selected weight plate, and the plates above it in weight stack 25, to stack pin 31. While machine 11 is illustrated as being a leg extension machine, those skilled in the art will recognize that the safety shield described below may be used in connection with any weight training machine that includes a stack of weights.

The safety shield of the present invention is designated generally by the numeral 43. Safety shield 43 may be sold initially as part of machine 11, or it may be sold as a retrofit kit to be installed upon an existing machine 11.

Figure 5:
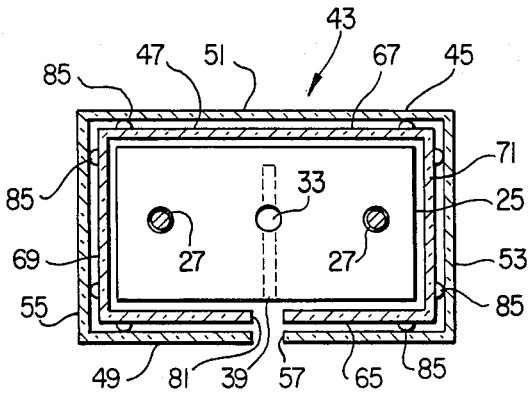
FIG. 5 is a sectional view taken along line 5—5 of FIG. 3 showing further details of the safety shield of the present invention.

Safety shield 43 includes a first shield member 45 and a second shield member 47. First shield member 45 is a box-like structure preferably made of a clear plastic such as acrylic or PVC. As is best shown in FIG. 5, first shield member 45 includes a front wall 49 and an opposed back wall 51 with side walls 53 and 55 connected therebetween. Front wall 49 includes an elongated slot 57 positioned to register with holes 39. Slot 57 allows retainer pin 37 to be inserted into holes 39 and it allows retainer pin 37 to travel upwardly and downwardly with the weight plates.

Referring particularly to FIG. 3, first shield member 45 also includes a bottom wall 59, which is connected to walls 49-55. Bottom wall 59 includes spaced apart holes 61 through which guide rods 27 pass, and a central hole 63, which receives the lower end of stack pin 31.

Bottom wall 59 of first shield member 45 is positionable beneath weight stack 25. Resilient washers 87 are positioned about guide rods 27 above and below bottom wall 59 to cushion the impact of weight stack 25 during operation thereby to prevent bottom wall 59 from being cracked.

Second shield member 47 is also a box-like structure preferably made of a clear plastic. As is best shown in FIG. 5, second shield member 47 includes a front wall 65 and an opposed back wall 67 with side walls 69 and 71 connected therebetween. Second shield member 47 also includes a top wall 73, which is positionable above weight stack 25. Top wall 73 includes spaced apart holes 75, which accommodate guide rods 27, and a central hole 77, which accommodates stack pin 31.

Top wall 73 of second shield member 47 is sandwiched between the top weight of weight stack 25 and a shield retainer 79. Shield retainer 79 is mounted on stack pin 31 between top wall 73 and master link 35. Shield retainer 79 fixes top wall 73, and thus second shield member 47, with respect to the top weight of weight stack 25, thereby making second shield member 47 movable with the movable weights.

Referring again to FIG. 5, front wall 65 of second shield member 47 includes an elongated slot 81 that registers with slot 57 of first shield member 45. Slot 81 allows access to holes 39 in the weight plates for the insertion of retainer pin 37.

In machine 11, the top several weight plates of stack 25 are narrower than the lower plates. The narrower weight plates allow users to increase weights in small increments at the lower weight range of the machine, but larger increments in the higher weight range. For example, the plates may be arranged such that the top ten plates are ten pounds each while the bottom five weights are twenty pounds each. The user can thus select weights from 10 to 100 pounds in ten pound increments and weights from 120 to 200 pounds in twenty pound increments.

In order to accommodate the differing weight plate widths, top wall 73 includes a pair of spaced apart ribs 89 which are positioned to engage the edges of the top weight plate. Ribs 89 aid in the alignment of second shield member 47.

First shield member 45 and second shield member 47 are open ended box-like structures that are engageable with each other in telescoping fashion. In the preferred embodiment, first shield member 45 forms a female part with second shield member 47 forming the male part. First shield member 45 is stationary during operation, but second shield member 47 moves up and down. By making second shield member 47 the male part, the moving end 83 of second shield member 47 is contained within first shield member 45 so that it does not present a safety hazard.

A plurality of buttons 85 of nylon or the like are connected to the walls 65–71 of second shield member 47. Buttons 85 space apart the respective walls of first shield member 45 and second shield member 47 so that they do not drag on each other. Such dragging would tend to scratch the walls and reduce their transparency and create more friction.

The combined length of first shield 45 and second shield 47 is selected to be at least equal to, and preferably greater than, the height of stack 25 plus the length of travel of the weights during operation so that the weight plates are encapsulated by safety shield 43 at all times. If the distance of travel or stroke of the weights is less than the height of weight stack 25, then the respective lengths of first shield member 45 and second shield member 47 can both be approximately the height of stack 25.

Safety shield 43 is easily installed on weight training machine 11 by technicians who have been trained in ordinary maintenance and assembly techniques, or by individuals with average mechanical ability and appropriate installation instructions. Master link 35 is first disconnected from stack pin 31 and then guide rods 27 are disconnected from housing 21. With the guide rods 27 disconnected from housing 21, but resting in openings in base 29, the weight plate stack 25 and guide rods 27 can be tilted away from machine 11 to provide clearance permitting removal of the weight plates of the weight stack 25. The weight plates of weight stack 25 are then lifted off guide rods 27. When the last weight plate has been removed, a first pair of resilient washers 87 are installed on guide rods 27 above base 29. First shield member 45 is then slipped over guide rods 27 through holes 61 of first shield member 45 and a second pair of resilient washers 87 are then installed around guide rods 27 above bottom wall 59 of first shield member 45. The weight plates of weight plate stack 25 are then loaded into first shield member 45 on guide rods 27 leaving the top weight plate of weight stack 25 with stack pin 31 connected thereto for last. After the complete set of weight plates of weight stack 25 and stack pin 31 has been loaded into first shield member 45, the second shield member 47 is installed on guide rods 27 through holes 75. Shield retainer 79 is then installed over the end of stack pin 31 and master link 35 is reconnected. Finally, guide rods 27 are reconnected to housing 21, thereby completing the installation.

After installation of safety shield 43, weight training machine 11 operates just as it did without safety shield 43. Chain 23 and guide rods 27 are accessable for routine maintenance, cleaning, and lubrication without removing safety shield 43. As previously mentioned, it is very desirable for the user to be able to see the number of weight plates being used at all times because of the psychological benefit to the user. For this reason, all walls of both shield members, or at least some of the walls, are clear or translucent to permit viewing of the weight plate stack during operation. In addition to enhancing the safety of weight training machine 11, safety shield 43 aids in keeping stack pin 31 properly aligned with center hole 33 in each weight plate throughout the travel of the selected amount of weight. Also, safety shield 43 protects painted weights from being scratched or chipped, and warning labels or instructional decals can be adhered to the surface of the top weight plate where they are protected from being removed or defaced.

Further modifications and alternative embodiments of the apparatus and method of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the size, shape and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. A safety shield for a weight training machine, said weight training machine including a stack of weight plates, a stack pin passing through said stack of weight plates, and a retainer pin for connecting a selected weight plate of said stack to said stack pin, said safety shield comprising:

a first shield member mountable about said stack of weight plates, said first shield member including a front wall having a slot positioned to receive said retainer pin;

and a second shield member telescopingly engageable with said first shield member, said second shield member including a front wall having a slot positioned to register with said slot of said first shield member to receive said retainer pin.

2. The safety shield as claimed in claim 1, wherein said front walls of said first and second shield members are transparent.

3. The safety shield as claimed in claim 1, including means positioned between said first shield member and said second shield member for preventing said front walls from contacting each other.

4. The safety shield as claimed in claim 1, wherein said first shield member includes:

a rectangular bottom wall positionable beneath said stack of weight plates with said front wall of first shield member extending upwardly from said bottom wall;

spaced apart side walls connected to said front wall of said first shield member and extending upwardly from said bottom wall;

and a back wall spaced apart from said front wall, said back wall being connected to said side walls and extending upwardly from said bottom wall.

5. The safety shield as claimed in claim 4, including bumper means for cushioning impact of said stack of weight plates on said bottom wall.

6. The safety shield as claimed in claim 5, wherein said bumper means includes at least one rubber washer disposed between said stack of weight plates and said bottom wall.

7. The safety shield as claimed in claim 4, wherein said second shield member includes:

a top wall positionable above said stack of weight plates with said front wall of said second shield member extending downwardly from said top wall;

spaced apart side walls connected to said front wall and extending downwardly from said top wall;

and a back wall spaced apart from said front wall, said back wall of said second shield member being connected to said side walls and extending downwardly from said top wall.

8. The safety shield as claimed in claim 7, wherein the combined length of said walls of said first and second shield member is at least equal to the height of said stack of weight plates plus the length of the stroke of said weight plates during operation of said weight training machine, whereby said weight plates are substantially completely enclosed by first and second shield members at all times during operation of said weight training machine.

9. The safety shield as claimed in claim 7, wherein said walls of said second shield member are disposed between the walls of said first shield member and said stack of weight plates.

10. The safety shield as claimed in claim 9, including means for spacing apart said walls of said first shield member from the walls of said second shield member.

11. The safety shield as claimed in claim 10, wherein said means for spacing apart said walls includes buttons connected to the walls of said second shield member, said buttons being adapted to contact the walls of said first shield member.

12. The safety shield as claimed in claim 7, wherein said top wall of said second shield member includes spaced apart means for engaging edges of the top weight plate of said stack of weight plates.

13. The safety shield as claimed in claim 7, including means for fixing said top wall of said second shield member to move with the top weight of said weight stack.

14. A safety shield for a weight training machine, said weight training machine including a stack of weight plates and means for connecting together selected weight plates of said stack to move with respect to the remaining weight plates of said stack, said safety shield comprising:

an open topped first shield member, said first shield member being adapted to surround the sides of said stack for at least a portion of the height of said stack;

means for fixing said first shield member with respect to said stack of weight plates;

an open bottomed second shield member adapted to telescopingly engage said first shield member and surround the sides of said stack for at least a portion of the height of said stack, said first and second shield members having a combined length at least equal to the height of said stack plus the length of travel of said weight plates during operation of said weight training machine;

and means for fixing said second shield member to be movable with the top weight plate of said stack during operation of said weight training machine.

15. The safety shield as claimed in claim 14, wherein: said means for fixing said first shield member includes a bottom wall of said first shield member positionable beneath said stack.

16. The safety shield as claimed in claim 14, wherein: said means for fixing said second shield member includes a top wall of said second shield member positionable above said stack.

17. The safety shield as claimed in claim 14, wherein: each of said first and second shield members includes a front wall having an elongated slot therein, said elongated slots registering with each other.

18. The safety shield as claimed in claim 15, including means for cushioning said bottom wall from impact of said weight plates.

19. The safety shield as claimed in claim 14, wherein at least a portion of each of said first and second shield members is substantially transparent.

* * * * *